United States Patent [19]

De Cuester et al.

[11] 4,415,836

[45] Nov. 15, 1983

[54] LAMP WITH IMPROVED FUSE WIRE

[75] Inventors: Robert J. M. De Cuester, Diest; Louis J. M. Hoeben, Hasselt, both of Belgium; Clair Wood, Brewer, Me.

[73] Assignee: GTE Products Corporation, Stamford, Conn.

[21] Appl. No.: 307,406

[22] Filed: Oct. 1, 1981

[51] Int. Cl.[3] ..... H01J 7/44; H01J 17/34; H01J 19/78; H01J 29/96; H01J 1/12

[52] U.S. Cl. ..... 315/50; 315/73; 315/74; 337/290; 337/416; 75/128 R

[58] Field of Search ..... 315/50, 73, 74, 75, 315/60; 75/124, 126 R, 128 R; 337/290, 416

[56] References Cited

U.S. PATENT DOCUMENTS

| | | | |
|---|---|---|---|
| 2,209,005 | 7/1940 | Sittel | 315/75 X |
| 3,346,768 | 10/1967 | Patsch | 315/74 |
| 3,737,717 | 6/1973 | Arendash | 315/75 |
| 3,940,728 | 2/1976 | Komatu et al. | 337/290 |
| 3,992,161 | 11/1976 | Cairns et al. | 75/126 R |

*Primary Examiner*—Saxfield Chatmon
*Attorney, Agent, or Firm*—Edward J. Coleman

[57] ABSTRACT

In an incandescent lamp having a glass envelope joined to a base member and a filament mounted within the envelope, an improved fuse wire comprises a portion of one or both of the lead-in wires connecting the filament to the base member. The fuse wire is made of an Aluchrom alloy containing Chromium, Nickel and Iron, or is made of a Cronifer alloy containing Chromium, Iron and Aluminum. The Aluchrom or Cronifer fuse wire, upon lamp failure and fuse burnout, exhibits reduced arcing melt-through of the lamp base compared with lamps having prior art fuse wires, for improved safety thereof.

Further the Aluchrom or Chronifer fuse wires have an $I^2t$ energy rating which permits the use of larger diameter fuse wires which can more readily be processed by lamp production machinery than the smaller diameter lamp fuse wires of prior art materials.

12 Claims, 4 Drawing Figures

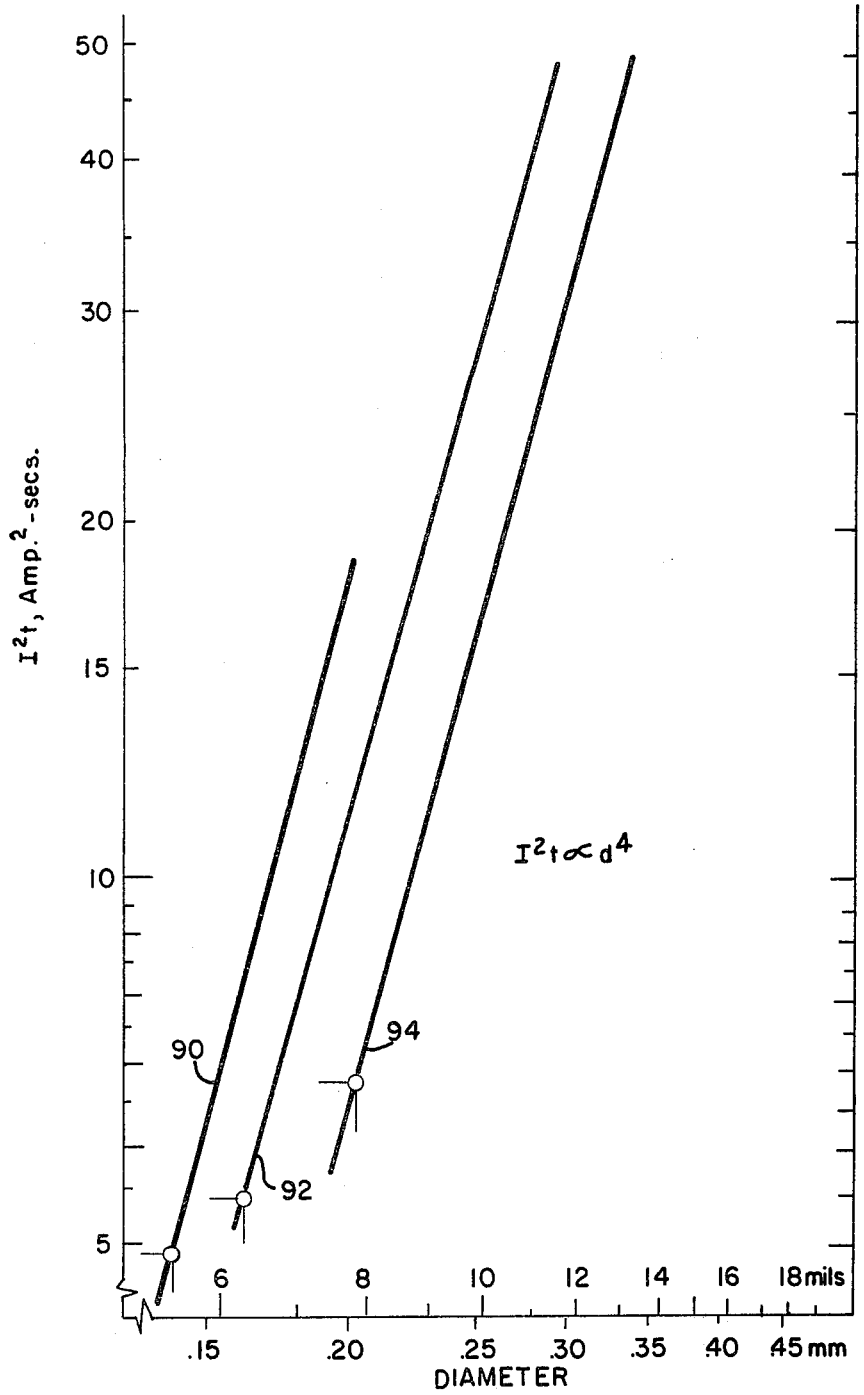
FIG. 4 $I^2t$ FUSE RATING AS A FUNCTION OF DIAMETER

LAMP WITH IMPROVED FUSE WIRE

BACKGROUND OF THE INVENTION

This invention relates to electric lamps and, more particularly, to a fuse wire for an electric lamp.

In the manufacture of electric lamps e.g. incandescent lamps, fuses e.g. of monel or nickel D wire are installed to interrupt excessive current flow therethrough to protect the lamp from damaging electric arcing. However upon filament failure and fuse burnout, one or more internal base arcs can develop, which can melt a hole through the lamp base and/or weld such base to the lamp socket with attendant risk of fire and personal injury.

To reduce such arcs, manufacturers have found it necessary to fill the lamp base with one or more insulative (sometimes porous) cement layers in an attempt to insulate the inside conductive surface of the base shell from fuse wire arcing. This type of solution requires additional steps in lamp manufacture and considerable expense and such base melt-through, though reduced, continues. For an example of a lamp base substantially filled with foamed cement, see U.S. Pat. No. 4,216,406 to Bjorkman et al. (1980).

A further shortcoming of the above conventional fuse wires is that in order to serve as a fuse for various lamps, e.g. 15 to 100 watts and higher, especially at 220 V to 245 V such fuse wires must be of a small diameter e.g. about 0.16 mm. Such small wire sizes are extremely difficult to handle in an automatic lamp production process, as the wire tends to kink and foul up under high speed machine manipulation.

Accordingly, such prior lamp fuses have not been satisfactory and there is a need and market for an improved lamp fuse which substantially overcomes the above prior art shortcomings.

By monel fuse wire as used herein is meant fuse wire of nickel/copper alloy in proportions well known in the art, e.g. a typical fuse wire material is monel 400 having a composition of nickel 63–70%, carbon 0.3% max., manganese 2.0% max., sulfur 0.24% max., silver 0.5% max. and a remainder of copper. All percentages noted herein are by weight unless otherwise stated.

SUMMARY OF THE INVENTION

Accordingly it is an object of the present invention to provide an improved fuse wire for an electric lamp which, upon fuse burnout, significantly reduces lamp base arcing.

It is a further object of the invention to provide an improved lamp fuse wire which is more compatible to high speed processing by machinery or equipment in lamp production.

These and other objects and advantages are accomplished in the present invention which provides in an electric lamp having a light-transmitting envelope containing an energizable source of light, a base secured to the envelope, a plurality of lead-in wires extending through the envelope and electrically connecting the light source to terminal means of the base, and an improved fuse wire included as at least a portion of one of the lead-in wires. The improved fuse wire comprises a material selected from the group consisting of a first alloy of 15% to 25% Cr, 70% to 80% Fe and 4.5% to 5% Al, which alloy is designated herein as Aluchrom, and a second alloy of 20% to 25% Cr, 20% to 30% Ni and 45% to 55% Fe, which alloy is designated herein as Cronifer. Aluchrom and Cronifer are alloy designations in Europe; e.g., Aluchrom is available from Vereinigte Deutsche Metallwerke A.G., Altena, West Germany. In the United States, an alloy similar to Aluchrom is available under the designation Alchrome from Wilbur B. Driver Co.

In the preferred embodiment, the improved fuse wire of the invention has a diameter of between 0.18 mm to 0.22 mm., though such diameter can be larger or smaller within the scope of the invention.

BRIEF DESCRIPTION OF THE DRAWINGS

The invention will become more apparent from the following detailed description and drawings, in which;

FIG. 4 is a graph illustrating certain characteristics of an improved fuse wire in a lamp embodying the present invention.

DESCRIPTION OF PREFERRED EMBODIMENTS

Figure 1:
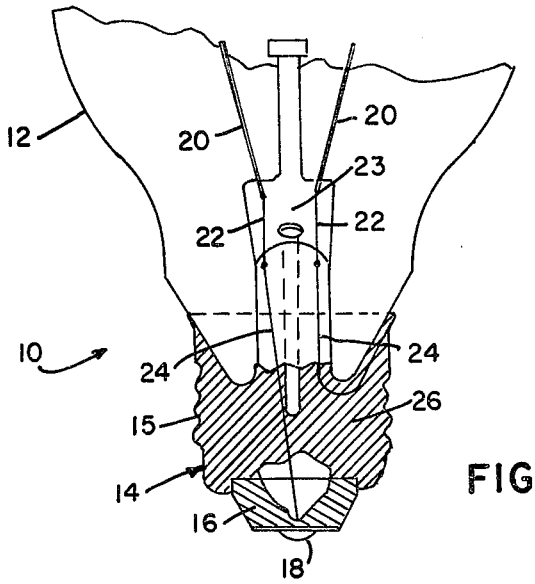
FIG. 1 PRIOR ART
FIG. 1 is a fragmentary elevation view, partly in section, of a prior art incandescent lamp.

Referring in more detail to the drawings, FIG. 1 shows a portion of a prior art incandescent lamp 10 having a light-transmitting, bulbous glass envelope 12 secured to base 14, which includes a metal shell 15, an insulative plug 16, and a center contact 18. Within the lamp, lead-in wires 20 connect with and support a coiled filament at both ends thereof (not shown). Each lead-in wire 20 includes an intermediate wire segment 22, e.g, of Dumet wire, which extends through and is sealed into the press on reentrant glass stem portion 23 of envelope 12. The outer ends of the wire segments 22, within the hallow of stem 23, are then connected to respective fuse wires 24 of e.g., monel, which in turn are connected to center contact 18 and the upper rim of base shell 15, respectively, as shown in FIG. 1. To lessen the problem of internal base arcs upon burnout of one or both of the fuse wires 24, the screw base 14 is filled with a quantity of insulative base cement 26, as shown in FIG. 1. However an internal base arc and melt-through can still develop upon fuse burnout with the above described consequences e.g. where a 0.16 mm dia. monel fuse wire is employed in lamps of 15 W to 100 W at 220 V to 245 V.

Figure 2:
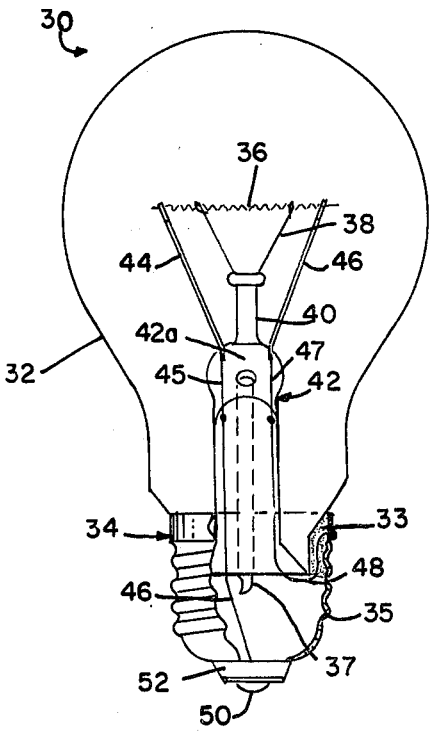
FIG. 2 is an elevation view, partly in section, of an incandescent lamp embodying the present invention.
Figure 3:
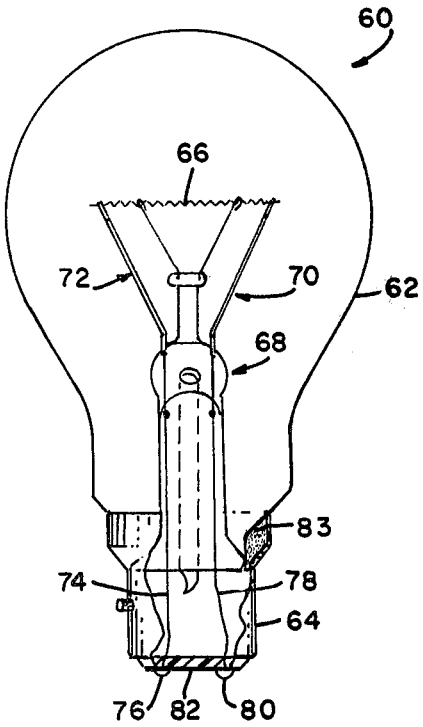
FIG. 3 is an elevation view, partly in section, of another incandescent lamp embodying the present invention.

A pair of incandescent lamps, having improved fuse wires according to the present invention, are illustrated in FIGS. 2 and 3. Lamp 30 of FIG. 2 has a light-transmitting, bulbous glass envelope 32 cemented to a typical screw base 34. Mounted within the envelope 32 is an energizable light source comprising a coiled filament 36, e.g., of tungsten, which is held by support wires 38, which are in turn mounted on a glass button rod 40 extending from a reentrant stem mount (or flair tube) 42, as shown in FIG. 2. The flare portion of the stem mount is sealed about the bottom periphery of the bulb portion of envelope 32, and the envelope, which contains an inert gas such as a mixture of nitrogen and argon, is hermetically sealed by tipping off exhaust tube 37. Electrically connected to each end of the filament 36 are lead-in wires 44 and 46, which on the interior of the envelope are typically of nickel or nickel-plated copper. These nickel wire segments respectively connect in turn to Dumet wire segments 45 and 47, which extend through and are sealed into stem press 42*a*. Dumet wire 45 is, in turn, connected with a fuse wire 46 of the invention, and the other end of fuse wire 46 is electrically connected, such as by solder, to center contact 50 of base 34. The Dumet wire 47 connects with a fuse wire 48 of the invention, which in turn is connected, such as by soldering, to the upper rim of metal screw shell 35 of base 34. The external base terminals comprising shell 35 and contact 50 are electrically isolated by insulative plug 52.

Alternatively, only one of the lamp lead-in wires may be fused, as is typical in the United States; for example, the lead-in wire 46 would be unfused whereupon the wire segment 48 connected to shell 35 could be, say, copper instead of a fuse wire material. Cement 33 bonds the bottom neck portion of envelope 32 to the metal shell 35 of base 34 as shown in FIG. 2. However there is no need to add insulative filler material within the remaining hollow interior of the base shell 34, due to the composition of the novel fuse wire 46 (and 48) as described below.

In another lamp with improved fuse wires embodying the invention, incandescent lamp 60 having a glass envelope 62 cemented to a double-contact bayonet-base 64, is shown in FIG. 3. The filament 66, the internal support structure 68 and the three-part lead wires 70 and 72 can be of the same structure and materials as those discussed above with respect to lamp 30 of FIG. 2., except that the three-part lead wire 72 includes a fuse wire 74 of the invention which is electrically connected, such as by soldering, to a contact 76, and the three part lead wire 70 includes a fuse wire 78 of the invention which connects with a contact 80, both of which contacts are mounted upon an insulative plate 82 for providing electrical isolation therebetween. Plate 82 is mounted in turn to the bayonet base 64 side shell, as shown in FIG. 3. The flared stem portion of support structure 68 is sealed about the bottom periphery of envelope 62, and the inert gas-filled envelope is hermetically sealed by tipping off the exhaust tube of structure 68. The bottom neck portion of envelope 62 and the bayonet base shell 64 are adhered together by cement 83. Again however, there is no need to add insulative filler to the remaining hollow interior of the bayonet base shell 64, due to the composition of the fuse wires of the invention, which composition is described below.

In designing the improved fuse wires of the invention, consideration was given to determining a material and wire diameter to provide a proper fusion time so that the fuse wire would generally not blow (produce an open circuit) during the inrush current at lamp switch-on but would trip (open circuit) prior to any significant increase in bulb pressure due to gas heating from the fuse failure arc. Another design consideration was to provide fuse wires of sufficient diameter to be reasonably processed by production machinery or equipment in lamp manufacture.

It was discovered that the preparation of fuse wires of Aluchrom, of the composition described hereinbefore, and fuse wires of Cronifer, of the composition described hereinbefore, meet the above design considerations. In addition, the improved fuse wires of the invention do not require the addition of insulative filler material to protect the interior of the lamp base shell. However, insulative filler can be added to the interior of a lamp base in combination with improved fuse wires of the invention, as desired, within the scope of the invention.

Further it was found that the energy rating of the fuse wires of the invention is such as to permit use of thicker wires than the prior art, e.g., monel wire, and yet maintain an equivalent energy rating therefor, which rating is more fully described below. Such prior art wires are required to be of small diameter e.g., about 0.16 mm for a monel fuse wire to act as a fuse. The improved fuse wires of Aluchrom or Cronifer can be larger in diameter and serve as a proper lamp fuse as tabulated below:

Aluchrom fuse wire: 0.20 mm to 0.22 mm

Cronifer fuse wire: 0.18 mm to 0.19 mm

Such fuse wires of the invention, though larger in diameter than, e.g., the Monel wire, are equivalent thereto in fuse energy rating as stated above. However the Aluchrom and Cronifer fuse wires, upon fuse burnout, more quickly extinguish internal base arcs that develop than their prior art counterparts, which results in less burnout of the lamp base shell as tabulated below.

A useful criterion for evaluation of fuse wires having different diameters is a plot of $I^2t$ against different fuse wire materials of various diameters. Accordingly, $I^2t$ is related to $d^4$ and plotted against diameter on a log—log graph to compare the energy rating for various diameter fuse wire materials, as shown in FIG. 4; where I is current, t is time and d is diameter and $I^2t$ is an energy rating for burnout of fuse wires at a comparable time and comparable arc (lamp failure) current. On such graph, plot line 90 represents the plotted data for a monel fuse wire with diameter 0.15 mm; plot line 92 represents the data for a monel fuse wire with diameter 0.16; and plot line 94 represents the data for Aluchrom fuse wire with diameter 0.20 mm. The circle points with vertical and horizontal extension lines represent the measurement points, whereas the remainder of the plot lines are extrapolated. As shown in the graph, larger diameter Aluchrom fuse wires have $I^2t$ ratings that are equivalent to those of smaller diameter monel fuse wires. For example an Aluchrom fuse wire having a diameter of 0.20 mm has an $I^2t$ rating equivalent to a monel fuse wire having a diameter of about 0.16 mm, as evident from examining FIG. 4. Specific examples of Cronifer and Aluchrom alloys employed in the improved fuse wires of the invention are as tabulated below in Table I.

TABLE I

Fuse Wire Alloys
Composition By Weight Percent

| Components | Cronifer III Extra NiCr 30 20 | Cronifer IV Extra CrNi 25 20 | Aluchrom O CrAl 25 5 | Aluchrom I CrAl 20 5 | Aluchrom W CrAl 15 5 |
|---|---|---|---|---|---|
| Cr | 20 | 25 | 25 | 20 | 15 |
| Ni | 30 | 20 | — | — | — |
| Fe | Remainder | Remainder | Remainder | Remainder | Remainder |
| Al | — | — | 5 | 5 | 5 |

An important physical property of fuse wires is the electrical resistance thereof. The resistivity of various fuse wire alloys discussed herein, at 20° C., is as follows:

| | |
|---|---|
| Monel 400 | 51 micro-ohm-centimeters |
| Aluchrom O (or Alchrome D) | 144 micro-ohm-centimeters |
| Aluchrom W (or Alchrome 750) | 125 micro-ohm-centimeters |

-continued

| | |
|---|---|
| Cronifer IV Extra | 95 micro-ohm-centimeters |

Tests were conducted to determine the performance of four groups of test lamps of 50 or more lamps per group, which groups had fuse wires as specified below. All of these test lamps were energized on a 10% overvoltage supply to see if the inrush current would blow any of the respective fuse wires. No lamp fuse wire exhibited this type of failure.

Another performance test, the "Schaffner test" was conducted on the above four groups of lamps. The test was conducted to see if any of the test lamps exploded or exhibited base arcing, i.e. an arc during the burnout of the filament upon fuse wire failure between one or more of the fuse wires and the base shell. Such arc, as previously discussed, can melt holes in the base shells of e.g., aluminum or brass. During such tests, no lamp explosions were noted. However base arcing holes in lamp base shells in various groups of the test lamps were recorded as follows in Table II.

TABLE II

| 225 V 100 W: Fuse Wire Alloy | Wire Dia. | Number of Lamps | Arc Holes in Base Shell | Percent Failure |
|---|---|---|---|---|
| Aluchrom O | 0.20 mm | 163 | 17 | 10.4 |
| Monel | 0.20 mm | 78 | 30 | 38.5 |
| Aluchrom O | 0.22 mm | 50 | 7 | 14.0 |
| Cronifer | 0.20 mm | 72 | 17 | 23.6 |

As shown in the foregoing Schaffner test, the lamps with fuse wires made of Aluchrom or Cronifer, upon fuse burnout, exhibited considerably less melt holes or base failure than did lamps with the prior art, e.g. monel, fuse wires. As indicated, the monel fuse wires in the lamps tested were 0.20 mm dia. Had monel fuse wire of 0.16 mm dia. been employed in some of the test lamps, the failure percentage might have been smaller, but an insulated filler would still have been desirable in the shell, and such thin or small diameter wire is difficult to process through lamp production machinery as previously stated.

Accordingly, fuse wires made with Aluchrom or Cronifer alloys, of the present invention are easier to process by lamp-making machinery, do not require insulative filler for the lamp base shells, and provide lamps with a considerably greater safety factor upon lamp failure and fuse burnout.

While there have been shown and described what are at present considered the preferred embodiments of the invention, it will be obvious to those skilled in the art that various changes and modifications may be made therein without departing from the scope of the invention as defined by the appended claims. For example, fuse wires according to the invention can also be useful in 120 volt incandescent lamps, such as commonly used in the United States, in which case only one of the lead-in wires may be fused. Further, the fuse wire can be used in lamps having one or more filaments, each connected to a respective pair of lead-in wires having one or both wires fused, and various types of filaments may be used, such as straight, coiled or coiled-coil. Also, alloys with similar compositions and resistivities can be employed as the fuse wire material; e.g., the aforementioned Alchrome D and Alchrome 750 alloys.

We claim:

1. In an electric lamp having an hermetically sealed, light-transmitting envelope containing an energizable source of light and having a sealed portion at one end, a base having terminal means and within which said sealed end portion of the envelope is secured, and a plurality of lead-in wires extending through the sealed end portion of said envelope and electrically connecting said light source to the terminal means of said base, the improvement comprising a fuse wire included as at least a portion of one of said lead-in wires, which fuse comprises material selected from the group consisting of a first alloy of 15% to 25% Cr, 70% to 80% Fe and 4.5% to 5% Al and a second alloy of 20% to 25% Cr, 20% to 30% Ni and 45% to 55% Fe.

2. The lamp of claim 1 wherein said fuse wire material is selected from said first alloy.

3. The lamp of claim 1 wherein said fuse wire material is selected from said second alloy.

4. The lamp of claim 2 wherein said fuse wire has a diameter in the range of 0.20 mm to 0.22 mm.

5. The lamp of claim 3 wherein said fuse wire has a diameter in the range of 0.18 mm to 0.19 mm.

6. The lamp of claim 1 wherein said fuse wire has a diameter in the range of 0.18 mm to 0.22 mm.

7. The lamp of claim 1 or 6 wherein said fuse wire is electrically connected in series with a segment of Dumet wire, which in turn is series connected to a wire segment of nickel or nickel-plated copper.

8. The lamp of claim 6 having a plurality of said fuse wires each included as at least a portion of a respective one of a plurality of said lead-in wires.

9. The lamp of claim 6 wherein said fuse wire electrically contacts a terminal means of said base.

10. The lamp of claim 8 wherein two of said fuse wires respectively contact two electrically isolated terminal means of said base.

11. The lamp of claim 9 wherein said base has a metal screw shell as one terminal means and an electrically isolated center contact as a second terminal means.

12. The lamp of claim 10 wherein said base is configured as a bayonet-base with a pair of electrically isolated contacts as said respective terminal means.

* * * * *